United States Patent [19]

Knell

[11] 4,381,030

[45] Apr. 26, 1983

[54] DUMMY BAR HEAD FOR A STEEL CONTINUOUS CASTING INSTALLATION CONTAINING AN OPEN-ENDED MOLD

[75] Inventor: Bernhard Knell, Thalwil, Switzerland

[73] Assignee: Concast AG, Zürich, Switzerland

[21] Appl. No.: 220,506

[22] Filed: Dec. 29, 1980

[30] Foreign Application Priority Data

Jan. 25, 1980 [CH] Switzerland ..... 605/80

[51] Int. Cl.[3] ..... B22D 11/08

[52] U.S. Cl. ..... 164/446; 164/426

[58] Field of Search ..... 164/446, 445, 426, 425

[56] References Cited

U.S. PATENT DOCUMENTS

| | | | |
|---|---|---|---|
| 3,525,381 | 8/1970 | Leese et al. | 164/426 X |
| 3,602,290 | 8/1971 | Schmidt et al. | 164/446 |
| 3,627,017 | 12/1971 | Knell et al. | 164/426 X |
| 3,643,731 | 2/1972 | Stull | 164/426 |
| 3,717,198 | 2/1973 | Marti et al. | 164/445 |
| 4,149,582 | 4/1979 | Johansson et al. | 164/426 X |
| 4,178,000 | 12/1979 | Kuttner | 164/425 X |
| 4,332,289 | 6/1982 | Reithner et al. | 164/446 |

FOREIGN PATENT DOCUMENTS

| | | | |
|---|---|---|---|
| 1954107 | 5/1971 | Fed. Rep. of Germany | 164/426 |
| 2731187 | 1/1979 | Fed. Rep. of Germany | 164/443 |
| 45-10321 | 4/1970 | Japan | 164/426 |
| 1503487 | 3/1978 | United Kingdom | 164/425 |
| 456676 | 2/1975 | U.S.S.R. | 164/425 |

*Primary Examiner*—Gus T. Hampilos
*Assistant Examiner*—J. Reed Batten, Jr.
*Attorney, Agent, or Firm*—Werner W. Kleeman

[57] ABSTRACT

A dummy bar head for a continuous casting installation, particularly for casting steel, containing a dovetail-shaped coupling portion which can be decoupled by carrying out a relative movement between the dummy bar head and the cast strand. The relative movement is undertaken in a direction approximately transverse to the strand withdrawal direction. To ensure a disturbance-free starting of the continuous casting operation, with high casting speeds, the dovetail-shaped coupling portion comprises a raised or protruding dovetail-shaped body. The dovetail-shaped body or body member essentially contains a trapezoidal-shaped surface area. A boundary surface of the raised body has aligned therewith a boundary surface of the dummy bar head which is arranged in the strand withdrawal direction and as to the remaining three boundary surfaces at least two oppositely situated ones thereof contain undercut portions.

10 Claims, 7 Drawing Figures

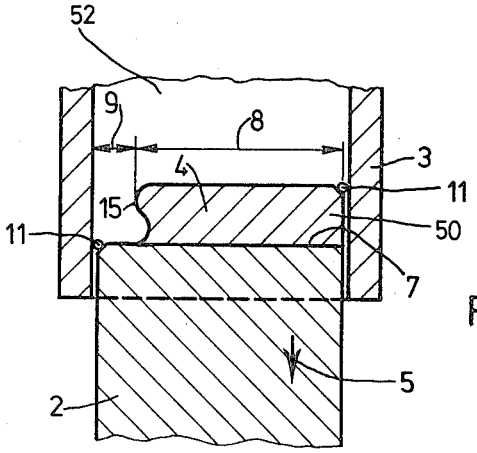
Fig. 1
Fig. 2
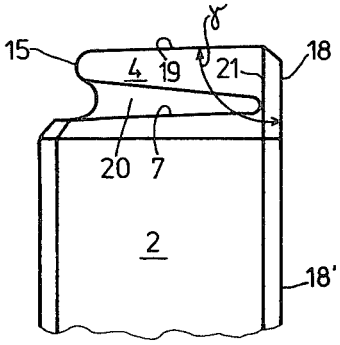
Fig. 3
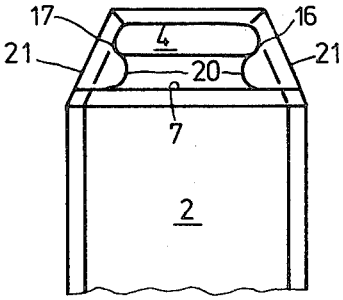
Fig. 4
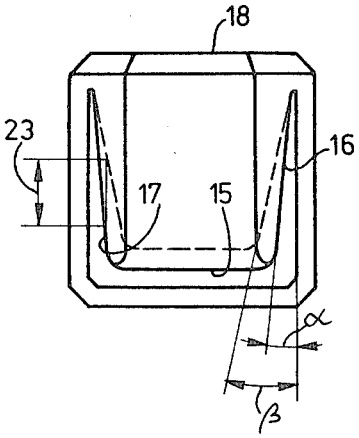
Fig. 5
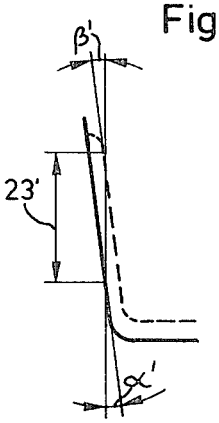

DUMMY BAR HEAD FOR A STEEL CONTINUOUS CASTING INSTALLATION CONTAINING AN OPEN-ENDED MOLD

BACKGROUND OF THE INVENTION

The present invention relates to a new and improved construction of a dummy bar head for continuous casting installations for casting metals, especially steel, and working with open-ended continuous casting molds.

Generally speaking, the dummy or starter bar head of the present invention is of the type containing an essentially dovetail-shaped coupling portion which, in the strand withdrawal direction, produces a positive connection with the cast strand. The coupling portion of the dummy bar head can be decoupled from the cast strand by carrying a relative movement, undertaken approximately transversely with respect to the strand withdrawal direction, between the dummy bar head and the cast strand.

In order to start-up the continuous casting operation of a continuous casting installation for casting strands with open-ended continuous casting molds there is needed a dummy or starter bar provided with a dummy bar head. This dummy bar head has a cross-sectional configuration which coincides with the hollow mold compartment and fits therein with only slight lateral play. Prior to the start of casting the intermediate spaces between the outer surfaces of the dummy bar head and the mold walls are sealed, to prevent that there are formed casting start-up metal breakouts. The steel which is cast into the hollow mold compartment at the start of the continuous casting operation solidifes upon coming into contact with the cooled mold walls and the cold dummy bar head. By virtue of certain constructional features of the dummy bar head there is formed a force-locking connection between the dummy bar head and the hot strand following solidification of the strand. This connection enables withdrawing the cast strand with the aid of the dummy bar out of the continuous casting mold. Following the driving rolls of the continuous casting machine the dummy bar is disconnected from the hot strand.

It is known from U.S. Pat. No. 2,079,644 to provide a dummy bar head, prior to the start of the casting operation, with an insertable coupling element. This coupling element which is releasably connected with the dummy bar head is cast into the molten metal during the starting of the casting operation, to thus form a firm connection. After the cutting operation the coupling element remains embedded in the hot strand and cannot be reemployed for any further casting operations or pours. This results in additional costs, both for the coupling elements and also for their insertion into the dummy bar head.

An appreciable improvement is realized when working with permanent dummy bar heads which, by virtue to their shape, form with the cast strand a connection or coupling, can be automatically decoupled and can be reused for a multiplicity of pours or casting operations.

It has already been proposed from U.S. Pat. No. 4,149,582 to provide permanent dummy bar heads with a dovetail-shaped recess which produces a rigid connection with the cast strand in the strand withdrawal direction and can be decoupled by carrying out a relative movement approximately transversely with respect to the strand lengthwise axis between the dummy bar head and the cast strand. To cool the dovetail-shaped coupling element which forms upon starting-up the continuous casting operation, it is recommended to incorporate cooling scrap elements into the dovetail-shaped recess of the dummy bar head. Notwithstanding this additional measure, when casting with non-regulatable pouring nozzles at the tundish and when working with high casting speeds, the solidification time for the formation of the cast coupling portion for a positive start-up of the casting operation is not sufficient, and furthermore, there cannot be precluded a tearing apart of the cast coupling portion with the subsequent danger of metal break-out during the start-up of the casting operation. To prolong the solidification time between the start of the casting operation and the beginning of the withdrawal of the strand out of the continuous casting mold it is conventional practice to use an emergency launder when working with a tundish having an open, non-regulatable pouring nozzle, so that there can be obtained interruption of the inflow of the metal. The use of the emergency launder is disturbing because steel splatters about the working areas at the casting platform, increases the danger of accidents for the casting personnel and causes losses in steel. Also there cannot be employed the advantages of automatic starting of the casting operation.

Other constructions of dummy bars are known to the art from U.S. Pat. Nos. 3,525,381, 3,602,290, 3,627,017 and 3,795,270.

SUMMARY OF THE INVENTION

Therefore, with the foregoing in mind it is a primary object of the present invention to provide a new and improved construction of a dummy bar head for continuous casting operations which is not associated with the aforementioned drawbacks and limitations of the prior art proposals heretofore discussed.

Another and more specific object of the present invention is directed to a new and improved construction of a permanent dummy bar head which overcomes the aforementioned drawbacks and enables a disturbance-free start-up of the continuous casting operation, even when working with high casting speeds.

Still a further significant object of the invention aims at providing a new and improved construction of dummy bar head which enables realizing the advantages which were heretofore obtained in this technology, such as security against undesired decoupling of the dummy bar head in a secondary cooling zone working with relatively few guide rolls, easy sealing of the dummy bar head in the continuous casting mold and a positive automatic decoupling of the dummy bar head at the contemplated decoupling location.

Now in order to implement these and still further objects of the invention which will become more readily apparent as the description proceeds, the substantially dovetail-shaped coupling portion comprises a raised or protruding dovetail-shaped body member or body. This body member contains an essentially trapezoidal surface area or base, a boundary surface of the raised body member is in alignment with the boundary surface of the dummy bar head arranged in the direction of strand withdrawal, and as to the remaining three boundary surfaces at least two oppositely situated ones thereof are provided with undercut portions.

The raised dovetail-shaped body member of such dummy bar head, by virtue of its configuration, in conjunction with the mold wall brings about a rapid solidification of the forming coupling portion at the hot strand because, on the one hand, the thermal energy or heat is withdrawn out of the cast coupling portion through the cooled copper wall of the mold towards the outside and, on the other hand, due to a snug bearing of the forming coupling portion at the body member the heat is withdrawn through the body member. Moreover, the solidification time of the cast coupling portion is favorably affected by the flow behavior of the cast steel at the region of the raised body member. An interruption of the steel inflow by the emergency launder is not needed, even at high casting speeds, so that there are eliminated all of the drawbacks associated with the use of an emergency launder. This construction of dummy bar head also allows for an automatic starting-up of the casting operation with high casting speeds. When using the inventive dummy bar head there can be dispensed with the need to employ prepared cooling scrap elements.

The solidification time of the cast coupling portion can be additionally reduced if, according to a further feature of the invention, the surface covered by the dovetail-shaped body member amounts to at least approximately 40% of the surface of the end face or side of the dummy bar head.

When working with larger cross-sectional areas of the continuous casting mold compartment it is advantageous when the covered surface, in the case of strand sectional shapes having a cross-sectional area of the hollow mold compartment beginning at 160 $cm^2$ and greater, amounts to at least 50% and with a cross-sectional area of the hollow mold compartment beginning at 260 $cm^2$ the covered surface amounts to at least 60%. Due to these measures it is possible to shorten the solidification times of the cast coupling portions when working with larger size billet and bloom cross-sections.

To form an advantageous sealing edge between the body member and a mold wall, the invention further proposes that the undercut portions of both boundary surfaces abutting at the fourth boundary surface run-out in the form of roof-shaped sealing edges. This measure allows for rapid and reliable application of a seal.

To apply the seal between the dummy bar head and the mold wall there is needed, on the one hand a sufficiently large gap between the body member and the mold wall. However, so that on the other hand the cast coupling portion can rapidly solidify it is necessary that the gap be maintained as narrow as possible. An advantageous solution according to the invention contemplates dimensioning the gap between the undercut boundary surfaces of the body member and the hollow mold compartment boundary so as to have a width which at most amounts to 25 mm.

The selection of the length of the decoupling path constitutes a contributing factor for the safety against undesired decoupling. According to the invention it is advantageous if there is provided a decoupling path of at least 20 mm. An enlargement of this path can be obtained in advantageous manner if the taper or slope angles $\alpha'$ and $\beta'$ at the body member are of the same magnitude.

As a further advantageous design of the inventive dummy bar head it is proposed, according to the invention, to construct the undercut portions as hollow throats or fillets. This produces a uniform solidification of the cast coupling portion, produces fewer thermal dam-up locations or bridges in the body member and ensures for an improved detachment during decoupling. Moreover, there is thus increased the service life of the dummy bar head.

The invention further proposes providing an enclosed angle $\gamma$ between the end face of the body member and the boundary surface of 80° to 89°. This measure further facilitates the decoupling operation.

According to a further feature of the invention, when working with a continuous casting installation having at least partially curved roller apron or strand guide arrangement, the boundary surface of the body member which is in alignment with the boundary surface of the dummy bar head is provided at the inner side of the curved roller apron and the decoupling location following the straightening unit or machine. It could be determined that when using this teaching upon passage of the coupling location through the straightening machine there surprisingly occurred a bending-up of the cast coupling portion, and thus, elimination of the contraction force. Positive decoupling with minimum forces effective transversely with regard to the direction of travel of the strand is therefore attainable.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a vertical sectional view through a partially illustrated continuous casting mold containing a likewise partially illustrated dummy bar head according to the invention;

FIG. 2 is a side view of the dummy bar head shown in FIG. 1;

FIG. 3 is a side view of the arrangement of FIG. 2;

FIG. 4 is a top plan view of the dummy bar head shown in FIGS. 2 and 3;

FIG. 5 is a detail illustration of a substantially dovetail-shaped body member according to a different embodiment of dummy bar head;

DETAILED DESCRIPTION OF THE PREFERRED EMBODIMENTS

Figure 6:
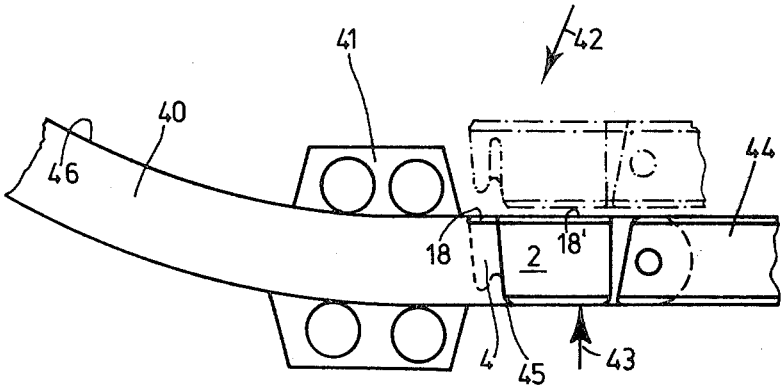
FIG. 6 is a side view of a decoupling location at a partially illustrated continuous casting installation for strand.

Describing now the drawings, it is to be understood that only enouggh of the construction of a continuous casting installation or machine with which the inventive constructions of dummy bar head are employed have been shown in the drawings to enable those skilled in the art to readily understand the underlying principles and concepts of the present development and to simplify the illustration of the drawings. Turning attention now to FIG. 1, there is illustrated therein a dummy bar head 2 which is arranged within an open-ended continuous casting mold 3. In FIGS. 2, 3 and 4 the continuous casting mold 3 has been omitted so as to more distinctly reveal the construction of the dummy bar head. In particular, it will be seen that the dummy bar head 2 i.e. the main body portion thereof is provided with an essentially dovetail-shaped coupled portion 50 composed of a raised or protruding essentially dovetail-shaped body or body member 4 which is bounded by the cross-hatching of the dummy bar head 2. Viewed in relation to the strand withdrawal direction 5 this body member 4 forms a connection with a cast strand, and such connection can be decoupled by carrying out a relative movement approximately transversely with respect to the strand withdrawal direction 5, for instance by utilization of a standard power or force-applying device, exerting a force and thus the mentioned relative movement between the dummy bar head 2 and the cast strand or casting. The raised dovetail-shaped body member 4 possesses an essentially trapezoidal surface area, and a boundary surface 18 of the body member 4 is in alignment with the boundary surface 18' of the dummy bar head 2 and which is arranged in the strand withdrawal direction 5. Three further boundary surfaces 15, 16 and 17 are provided with undercut portions 20. If desired, the undercut portion can be omitted at the boundary surface 15. In practice it is frequently sufficient to provide the undercut portions 20 at only both of the oppositely situated boundary surfaces 16 and 17.

The raised body member 4 is dimensioned such that it covers in toto at least approximately 40% of the surface of an end face or side 7 of the dummy bar head 2. Decisive as the covered surface is the surface projected from the body member 4 on to the end face or side 7. Reference character 8 designates the length of the body member 4 and reference character 9 designates the width of the gap between the boundary surface 15 of the body member 4 possessing an undercut portion and the boundary of the hollow mold compartment 52. The width of the gap 9 at most amounts to 25 mm. Reference character 11 represents a sealing cord for sealing the dummy bar head 2 in conventional manner. Such sealing cords 11, depending upon their size in section, have a diameter in the order of between 10 to 20 mm.

In the case of strand sectional shapes having a hollow mold cross-sectional area beginning at 160 $cm^2$ the covered surface amounts to at least 50% and in the case of a hollow mold cross-sectional area beginning at about 260 $cm^2$ such covered surface amounts to at least 60%.

The undercut portions 20 and the oppositely situated boundary surfaces 16 and 17 extend in the direction of the fourth boundary surface 18 and terminate in a substantially roof-shaped sealing edge 21. The angle $\alpha$ constitutes the slope or taper angle of the protruding dovetail-shaped portion and the angle $\beta$ constitutes the taper or slope angle of the undercut dovetail-shaped portion. By appropriately selecting both of the angles $\alpha$ and $\beta$ and the undercut depth there is formed a decoupling path 23 which advantageously amounts to at least 20 mm. It is advantageous if the angle $\alpha$ is selected in a range of 3° to 5° and the angle $\beta$ in a range of 6° to 10°.

The undercut portions 20 are constructed as hollow throats or fillets and all edges of the body member 4 are rounded or bevelled. An angle $\gamma$ enclosed between the end side or face 19 of the body member 4 and the boundary surface 18 is in the order of between 80° and 89°.

In FIG. 5 the taper angle $\beta'$ of the undercut portion and the taper angle $\alpha'$ of the protruding dovetail-shaped portion are of the same magnitude. Reference character 23' designates the decoupling path.

In FIG. 6 there has been illustrated by reference character 40 a curved cast strand. The tip of this strand 40 has been straightened in a driving and straightening assembly or machine 41 and is located at a decoupling location 42. By means of a force acting in the direction 43, for instance generated by a piston-and-cylindary unit serving as the force-applying device, a dummy bar 44 can be decoupled from the cast strand 40. The boundary surface 18 of the body member 4 which is in alignment with the boundary surface 18' of the dummy bar head is provided at the inner side 46 of the curved roller apron. During straightening of the strand the cast coupling portion is upwardly pressed due to the straightening force which is applied to the dummy bar head, because the dummy bar head is slightly tilted about the edge 45. Consequently, the contraction force exerted at the raised body member 4 is generally eliminated and there is rendered possible a disturbance-free decoupling operation.

Figure 7:
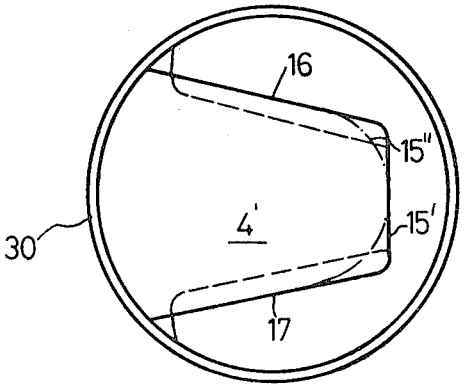
FIG. 7 is a top plan view of a dummy bar head having a circular cross-sectional configuration.

FIG. 7 illustrates the trapezoidal surface area of the dovetail-shaped body member 4' with a round strand cross-section. The essentially trapezoial surface area is enclosed by the straight boundary surfaces 15', 16 and 17 and the circular-shaped boundary surface 30. As an equivalent modification there has been shown in broken lines, an approximately semicircular-shaped boundary surface 15".

The inventive dummy bar head is particularly suitable for use with billet or bloom continuous casting installations. In addition to rectangular sectional shapes, which normally are cast upon such casting machines, the dummy bar head also can be used for multi-cornered sectional shapes. This is equally true for continuous casting installations working with straight or arc-shaped or curved molds and straight and/or curved roller aprons, respectively.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A dummy bar head for use with a continuous casting installation equipped with an open-ended mold for casting therein a strand withdrawn in a predetermined strand withdrawal direction, comprising:

a main body portion having a boundary surface arranged in the strand withdrawal direction;

a substantially dovetail-shaped coupling portion integral with said main body portion;

said coupling portion having surfaces adapted to form a connection with the cast strand in the strand withdrawal direction;

said connection of said coupling portion being capable of being decoupled from the cast strand by carrying out a relative movement between the dummy bar head and the cast strand which extends approximately transversely with respect to the strand withdrawal direction;

said dovetail-shaped coupling portion comprising a raised body member having a boundary surface in alignment with said boundary surface of said main body portion;

said raised body member having three additional boundary surfaces;

at least two of said additional boundary surfaces being located opposite one another;

said oppositely located boundary surfaces being provided with undercut portions;

said raised body member having a dovetail shape in cross-section taken along a plane parallel to the boundary surface; and said raised body member having a substantially trapezoidal surface area bounded by the boundary surface and the three additional boundary surfaces.

2. The dummy bar head as defined in claim 1, wherein:

said substantially dovetail-shaped body member covers a surface of said main body portion which amounts to at least approximately 40% of the surface of an end face of said main body portion.

3. The dummy bar head as defined in claim 2, wherein:

said covered surface amounts to at least 50% when casting strand sectional shapes with a hollow mold compartment cross-sectional area which at least amounts to 160 $cm^2$.

4. The dummy bar head as defined in claim 2, wherein:

said covered surface amounts to at least 60% when casting strand sectional shapes with a hollow mold compartment cross-sectional area amounting to at least 260 $cm^2$.

5. The dummy bar head as defined in claim 1, further including:

a gap of at most 25 mm provided between the boundary surfaces of the body member provided with said undercut portions and a boundary surface of a hollow mold compartment of the open-ended mold.

6. The dummy bar head as defined in claim 5, wherein:

said undercut portions of said two boundary surfaces abut the boundary surface of the raised body member and terminate in substantially roof-shaped sealing edges.

7. The dummy bar head as defined in claim 1, wherein:

said body member is configured to provide a decoupling path amounting to at least 20 mm.

8. The dummy bar head as defined in claim 1, wherein:

said body member is configured to have taper angles of equal magnitude.

9. The dummy bar head as defined in claim 1, wherein:

said undercut portions define hollow fillets.

10. The dummy bar head as defined in claim 1, wherein:

said body member has an end face which encloses with said one boundary surface of said body member which is in alignment with said boundary surface of said main body portion an angle in a range of about 80° to 89°.

* * * * *